US006260209B1

(12) United States Patent
St. Ange

(10) Patent No.: US 6,260,209 B1
(45) Date of Patent: Jul. 17, 2001

(54) SEPARABLE PANTS ASSEMBLY

(76) Inventor: Helene St. Ange, P.O. Box 171901, Hialeah, FL (US) 33017-1901

( * ) Notice: Subject to any disclaimer, the term of this patent is extended or adjusted under 35 U.S.C. 154(b) by 0 days.

(21) Appl. No.: 09/431,025

(22) Filed: Oct. 25, 1999

(51) Int. Cl.[7] ..... A41D 1/06
(52) U.S. Cl. ..... 2/227
(58) Field of Search ..... 2/227, 114, 69

(56) References Cited

U.S. PATENT DOCUMENTS

| | | | | |
|---|---|---|---|---|
| 2,264,958 | * | 12/1941 | Smith | 2/227 |
| 5,008,962 | * | 4/1991 | Smith et al. | 2/227 |
| 5,553,323 | * | 9/1996 | Chou et al. | 2/114 |
| 5,802,611 | * | 9/1998 | McKenzie et al. | 2/69 |
| 6,049,913 | * | 4/2000 | Harrigan et al. | 2/227 |

FOREIGN PATENT DOCUMENTS

| | | | | |
|---|---|---|---|---|
| 241637 | * | 8/1944 | (CH) | 2/227 |
| 303253 | * | 9/1954 | (CH) | 2/227 |
| 1014844 | * | 3/1950 | (FR) | 2/227 |
| 1043630 | * | 10/1951 | (FR) | 2/227 |

* cited by examiner

*Primary Examiner*—Bibhu Mohanty

(57) ABSTRACT

A pants assembly including an upper portion dimensioned and configured to be secured in substantially surrounding relation about the wearer's waist and a lower portion depending downwardly from the upper portion in covering relation to a lower torso and at least an upper leg portion of the wearer depending upon the length of each pant leg. The pants assembly is particularly designed for use by law enforcement or other uniformed personnel as part of a standard uniform which requires the additional wearing of a utility or gun belt structured to be secured about the exterior surface of the upper portion and designed to hold a handgun, radio, hand-cuffs and/or a number of other devices used in the performance of the person's duties. An attachment assembly is provided for interconnection and at least partial, selective separation of the inner leg seam lines from one leg to the next in order to facilitate the access of the wearer to toilet facilities without requiring the removal of the upper portion of the pants assembly and accordingly, the gun belt or other utility belt attached thereto.

1 Claim, 2 Drawing Sheets

SEPARABLE PANTS ASSEMBLY

BACKGROUND OF THE INVENTION

1. Field of the Invention

A pants assembly designed to be used in combination with a utility belt or a gun belt of the type typically worn by uniformed police officers, wherein an upper waistband portion of the pants assembly remains in a secured position about the wearer's waist is attached to a lower, portion of the pants assembly such that the utility belt is still in place, without requiring the removal of the utility belt as well as the upper portion about which it is secured. Thereby facilitating access to a toilet facility to the wearer by separating along the inner leg seam vertically from one leg to the next in a manner to lower the underwear of the wearer when necessary.

2. Description of the Related Art

It is well known that uniformed police officers are required to adhere to a strict dress code in terms of standard, substantially identically uniforms. As a requisite part of such uniform, police officers, whether male or female are required to include a belt with a handgun, radio, handcuffs and/or other objects which aid in the conducting of their duty. Typically, the "utility belt" used to support the handgun as well as the other above noted objects, is secured in a somewhat conventional fashion generally about the waist of the wearer and in supported or removably secured relation to the exterior surface of the waist portion of the pants assembly defining a part of the uniform, such as through belt loops. Because of the weapon and other objects carried on the supporting belt, such belt becomes extremely heavy, bulky, and as a result extremely troublesome to repeatedly detach and remove from the wearer and then replace in its proper location along with the pants.

Professions other than police officers also frequently require the wearing of certain uniforms as well as some type of utility belt which is used to support tools, radios/phones, etc. needed in the performance of the wearer's job duties. Naturally, a utility or tool belt of the type required also becomes extremely heavy due to the weight of the tools or like objects supported thereon.

Because of the difficulties and/or general inconvenience associated with removal and replacement of such utility belts, and because of the need to maintain the utility belt and gun in a safe location, there is a tendency, particularly with uniformed employees of the female gender, to resist removal of such utility belts even in times of necessity, such as when the wearer must access toilet facilities. The result is a tendency to delay in the removal of the belt and accordingly a delay or postponement of the use of toilet facilities. Indeed, it has been established that prolonged or repeated delays of the act of urination may possibly result in urinary infections, which in turn, if continued, can result in even more serious medical complications. Male employees, regardless of their profession, involved in those job descriptions which require the wearing and utilization of a utility or tool belts are not faced with the problem of repeatedly removing and replacing such belts since the conventional design for a pants assembly or trousers normally includes a frontal opening particularly structured to avoid the removal or lowering of the trousers for purposes of urinating. However, even though the frequency of removal of such heavy, cumbersome belts of the type described, does not occur with such frequency as with female uniformed personnel, there are less frequent occurrences where accessing toilet facilities is necessary. As a result, the trousers have to be lowered, in turn causing the utility belt to be removed.

It is also recognized that other conventional articles of clothing do not take into considerations the problems faced by uniformed personnel required to wear heavy, cumbersome, utility and/or gun belts of the type set forth above. Accordingly, such conventional articles would not be adaptable to standardized or substantially conventional uniforms of clothing articles such as pants or trousers.

There is a recognized need, therefore, for a pants assembly which allows the wearer to have access to toilet facilities with normal frequency without requiring the removal of the gun belt, utility belt, etc. Such a preferred structure would allow at least partial separation of the vertical inner leg seams of the pants (unzipping from one leg up to the crotch and down to the next leg) wherein the bottom portion of the pants looks like a skirt for purposes of providing toilet access to the wearer or for any reason. In turn, the utility belt, remains positioned in supported orientation about the exterior surface of the upper waistband portion. In addition, such a preferred pants assembly should have the outward appearance and overall design or configuration substantially identical to conventional trousers or pants such that, if desired, a female uniformed employee could wear the preferred, separable pants assembly and male employees, because of the conventional design of trousers, could wear conventional pants. In this instance, the outward appearance of both the preferred, separable pants assembly and substantially the same.

SUMMARY OF THE INVENTION

The present invention is directed towards a separable pants assembly particularly of the type which may be utilized as part of a uniform for police officers or other personnel requiring the wearing of uniforms and also requiring the wearing of some type of utility belt. In the situation involving uniformed police officers, the belt on which a hand gun is supported normally carries other objects or devices to aid in the performance of the police officer's job requirements. In such instances, the gun belt or utility belt is generally mounted in a removable but supported fashion about the exterior surface of the waist portion of the pants assembly defining a part of the uniform. Accordingly, in order to avoid the necessity of repeatedly removing and replacing the gun belt or utility belt when the wearer thereof is required to use toilet facilities, the present invention comprises a pants assembly having a separable inner leg seam portion.

More specifically, the pants assembly is of conventional construction and style. The utility and gun belt is secured in a position generally surrounding the waist of the wearer. The lower portion of subject pants assembly is dimensioned and configured to cover the lower torso and at least the upper leg portion of the wearer, depending upon the length of the pant legs. A frontal opening is conventionally positioned and includes an open and upper end and a closed lower end.

A separating assembly is secured in part to both the inner leg seams running continuous to the next leg. More specifically, it is structured to establish a separable interconnection between the inner leg seams from one leg to the next beginning at the fold of the hemline by embodiment of a conventional or separating zipper. In a preferred embodiment, the attachment assembly may be in the form of an elongated zipper. Alternately, the attachment assembly may include a plurality of spaced apart cooperatively structured first attachment components and second attachment components, respectively mounted in the inner leg seams running continuous to substantially aligned relation to one another. Correspondingly positioned ones of the first and second attachment components may be readily connected and disconnected from one another depended upon whether the wearer desires the inner leg seams to be separated. Such a variety of additional embodiments could include buttons and button holes, snaps, hook and loop type fasteners, etc.

The zipper position is further defined by a relative to the attachment assembly along the length thereof. Therefore, the attachment assembly is not readily viewable or detectable, which is of particularly importance for uniformed personnel requiring uniformity of dress.

Therefore, it is a primary object of the present invention to provide a separable pants assembly which facilities without the removal of a utility belt secured to the pants assembly, generally about the waist of the wearer.

Another primary object of the present invention is to provide a separable pants assembly which is simple and convenient to adjust into a separated position such that access to toilet facilities can occur at normal frequency and with a minimum of effort on the part of the wearer.

Yet another important object of the present invention is to provide a separable pants assembly which is substantially identical to pants of conventional design thereby enabling standardization of appearance of similarly uniformed personnel.

Still another important object of the present invention is to provide a separable pants assembly which is designed to be manufactured at substantially equivalent prices such that wearer of the subject pants assembly will not be economically disadvantaged. which is designed and structured to facilitate the removable support and attachment of any number of conventionally sized utility belts about an exterior surface of an upper portion of the pants assembly generally in surrounding relation to the waist portion of the wearer.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying Figures, the present invention is directed towards a pants assembly, generally indicated as 10. The pant assembly 10 compromises an upper waistband portion, generally indicated as 12, and a lower portion, generally indicated as 14. The upper portion 12 is sewn & attached to the lower portion 14. The lower portion 14 may include a front opening 19 extending vertically therein. An important feature of the present invention is the existence of a separating/attachment assembly generally indicated as 20, which in the embodiments of FIGS. 1–2.

Figure 1:
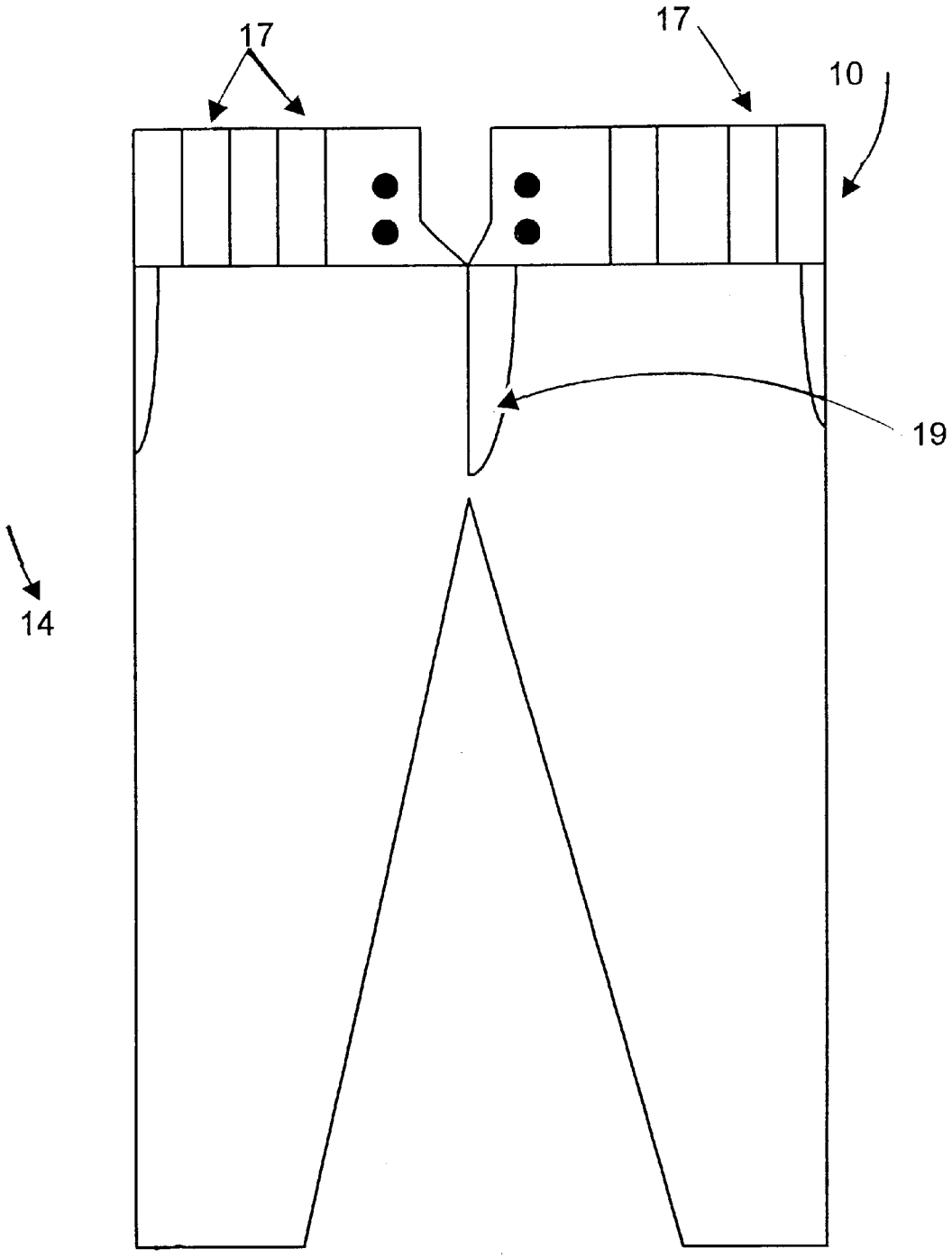
FIG. 1 is a perspective view of a separable pants assembly of the present invention in assembled form.
Figure 2:
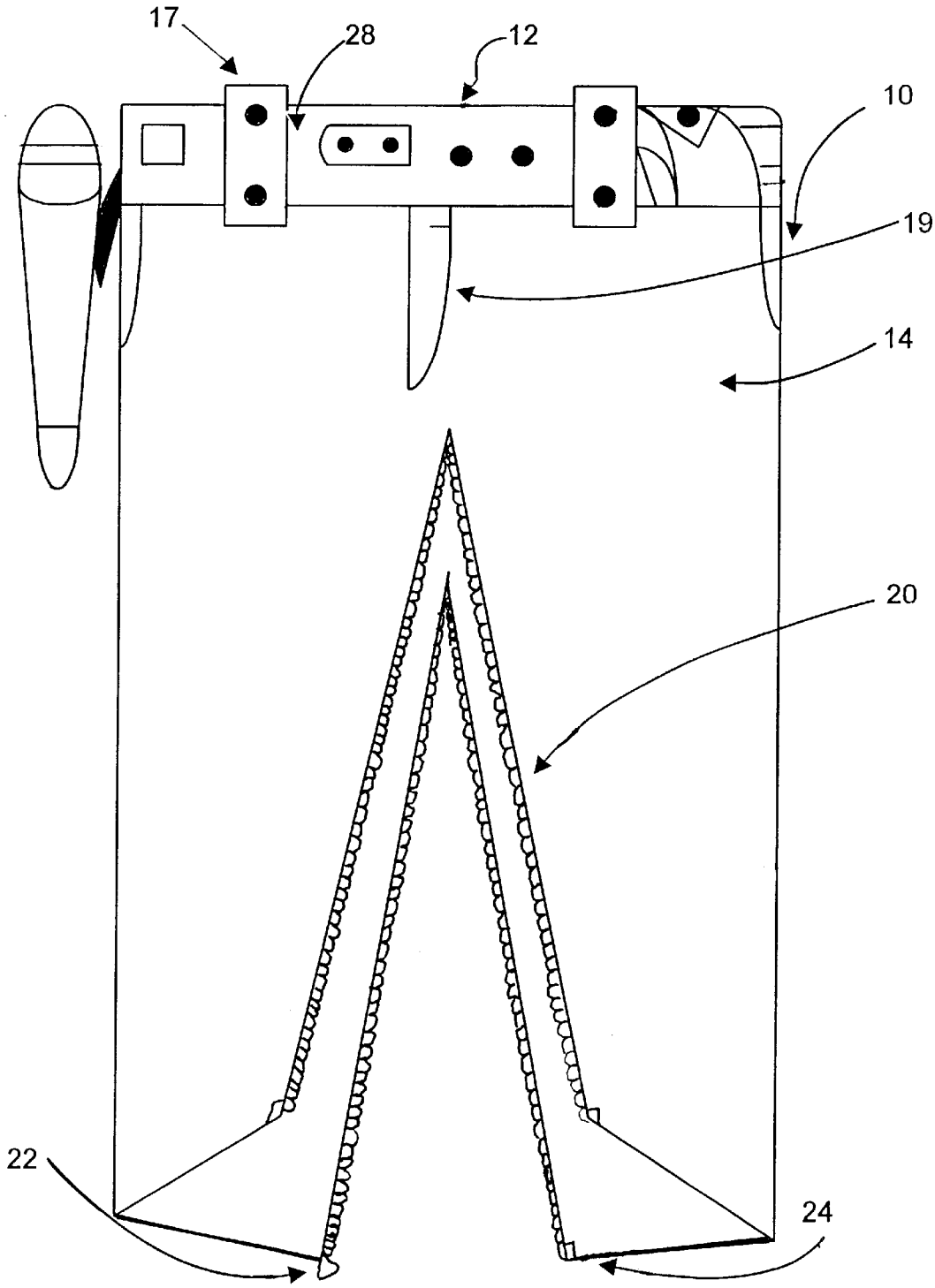
FIG. 2 is a front plan view of the pants assembly of the present invention in separable form. Other form of embodiment can be placed in the same position.

In the embodiment show in FIGS. 1–2, the attachment assembly 20 is preferably in the form of a zipper structure such that a first component of the zipper defines the attachment assembly portion 22 and the mating or second component of the zipper structure defines the second attachment portion 24. The attachment assembly preferably has a zipping mechanism including both of its components 22 and 24 extending respectively along preferably the majority of the length of the inner leg seams of the lower portion of 14. By virtue of this structure, the attachment assembly 20 serves to separate and attach the inner leg seams in depending, vertically oriented relation in the lower portion 14. This "separable" feature of the lower portion 14 allow selective separation of the lower portion 14 in the inner leg seams such as when the wearer of the pants assembly 10 needs to have access to toilet facilities. In such an occurrence, the upper portion 12 and the lower portion 14 may remain on, based on the requirements of the wearer, without the necessity of removing or detaching the utility belt 28. More specifically, the upper portion 12 has an exterior surface which is dimensioned and configured to allow attachment an/or removable support of a utility belt 28 thereto. The utility belt 28 may be of the type used to carry heavy objects or equipment such as a gun belt of a police officer or alternately may be a tool belt designed to carry a plurality of tools as well as other objects necessary for the performance of an employees job duties. As such a mounting assembly may be formed on the exterior surface of the upper portion 12, and preferably may be in the form of a plurality of belt loops, as it 17, disposed in somewhat surrounding and supporting relation to spaced apart portions of the utility belt 28. Without the separable feature of the present invention, whereby the inner leg seams in the lower portion 14 are selectively separated, it would be required to first detach the utility belt 28 and possibly remove it from its supported position, whether or not the mounting components 17 are present or not, such that it does not rest on the floor or in a vulnerable position. As such, the separable feature of the lower portion 14 of the pants assembly 10 allows separation thereof from the inner leg seams of the lower 14 thereby allowing the upper waist portion 12 to be maintained in its secured position about the waist of the wearer. More importantly, the utility belt 28 is maintained in its fixed and supported position about the exterior surface of the upper waist portion 12.

Another embodiment of the present invention wherein a cover generally indicated as is selectively positional in overlying and covering relation to the attachment assembly 20. More specifically, the cover is in the form of a drape structure having an upper end preferably secured to the inner leg seam 20 of the lower portion 14 so as to depend vertically longitudinally downward therefrom in overlying relation to the attachment assembly 20. The lower end 36 of the drape structure may be removably secured to the inner leg seam of the lower portion 14 so as to maintain the drape structure in the covering position relative to the attachment assembly 20. Furthermore, the existence of the drape structure effectively prohibits the detection of the attachment assembly 20, along its entire length, thereby giving the pants assembly 10 and exterior appearance that is the same as that of a conventionally designed and structured pants assembly, absent the separable feature of the present invention. It is noted that the attachment assembly of the pants assembly lower portion 14 may be secured to the inner seams of the lower portion 14 by any type of removable coupling structure such as conventional hook and loop type, button, velcro, snaps connector wherein such connector is indicated attachment assembly 20.

Yet another embodiment of the present invention is demonstrated and compromises the attachment assembly 20 including a plurality of first attachment components each of which are mounted in spaced relation to one another on the exterior surface of the lower portion 14. From the embodiment, the first and second plurality of attachment components are in the form of buttons and button holes respectively. However, it is within the intended scope of the present invention to substitute a variety of different first and second components such as snaps, hooks, clips, and/or hook and loop type fasteners, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Due to the different shapes, sizes, and forms of individuals, Joella's design (U.S. Pat. No. 5,819,320) requires more effort from the wearer and is more time consuming to unzip the top portion horizontally; unzip the conventional flyer; then lower the pant. After using the restroom the wearer must tuck the shirt into the lower portion of the pants, zip the flyer, and reattach the top portion to the lower portion. Manufacturing Joella's product would be more expensive due to special attention that must be given to the details in placement of the zipper along the various waistband sizes. Extra materials will be needed to accommodate the wear of frequent separation of the waistband from the lower portion. My initial design, which was rejected, was identical to Joella's design U.S. Pat. No. 5,819,320. I had the opportunity to make a sample.

Now that the invention has been described, What is claimed:

1. In combination, a pair of pants and a utility or police gun belt, said pants comprising:

a) an upper portion dimensioned and configured for mounting in a secured portion about a wearer's waist, said upper portion having means to secure the police utility belt thereto, b) a lower portion extending downwardly from the upper portion and covering each of the wearer's legs, c) an attachment assembly attached on inner leg seams of the lower portions or in an adjacent area, d) a cover overlying the attachment assembly.

* * * * *